United States Patent [19]

O'Donnell

[11] Patent Number: 4,693,059

[45] Date of Patent: Sep. 15, 1987

[54] MANDREL FOR OPENING A TUBE OF FLEXIBLE MATERIAL

[75] Inventor: John B. O'Donnell, Sellersville, Pa.

[73] Assignee: Rorer Pharmaceutical Corporation, Fort Washington, Pa.

[21] Appl. No.: 835,042

[22] Filed: Feb. 28, 1986

[51] Int. Cl.[4] ..... B65B 9/10

[52] U.S. Cl. ..... 53/567; 53/291; 53/585; 493/309

[58] Field of Search ..... 53/291, 296, 297, 551, 53/554, 567, 582, 585, 557; 493/295, 302, 309, 355, 400, 401, 402, 403

[56] References Cited

U.S. PATENT DOCUMENTS

| | | | |
|---|---|---|---|
| 416,115 | 11/1889 | Mayall | 493/400 |
| 4,148,171 | 4/1979 | Westlund | 53/585 |
| 4,255,223 | 3/1981 | Saul | 493/295 |
| 4,514,966 | 5/1985 | Konstantin | 53/585 |

FOREIGN PATENT DOCUMENTS

| | | | |
|---|---|---|---|
| 2536736 | 6/1984 | France | 53/585 |

*Primary Examiner*—Robert L. Spruill
*Assistant Examiner*—Donald R. Studebaker
*Attorney, Agent, or Firm*—James A. Nicholson; Alexis Barron; Martin F. Savitzky

[57] ABSTRACT

A mandrel for opening a tube of flexible banding material wherein the tube is delivered in flat ribbon-like form with creased side edges is disclosed. The mandrel is in the form of a tetrahedron with two sets of surfaces which are in the form of isosceles triangles with each set of faces inclining towards one another to form a common base. A pair of relatively yieldable, sharp-edged wedging elements are disposed on each common base. Biasing means bias the wedging elements outwardly to limit positions at the ends of the common bases. Use of the mandrel to open a tube of flexible, heat-shrinkable banding material and creasing the material at points displaced 90° from the initial creases is disclosed.

3 Claims, 7 Drawing Figures

FIG. 3
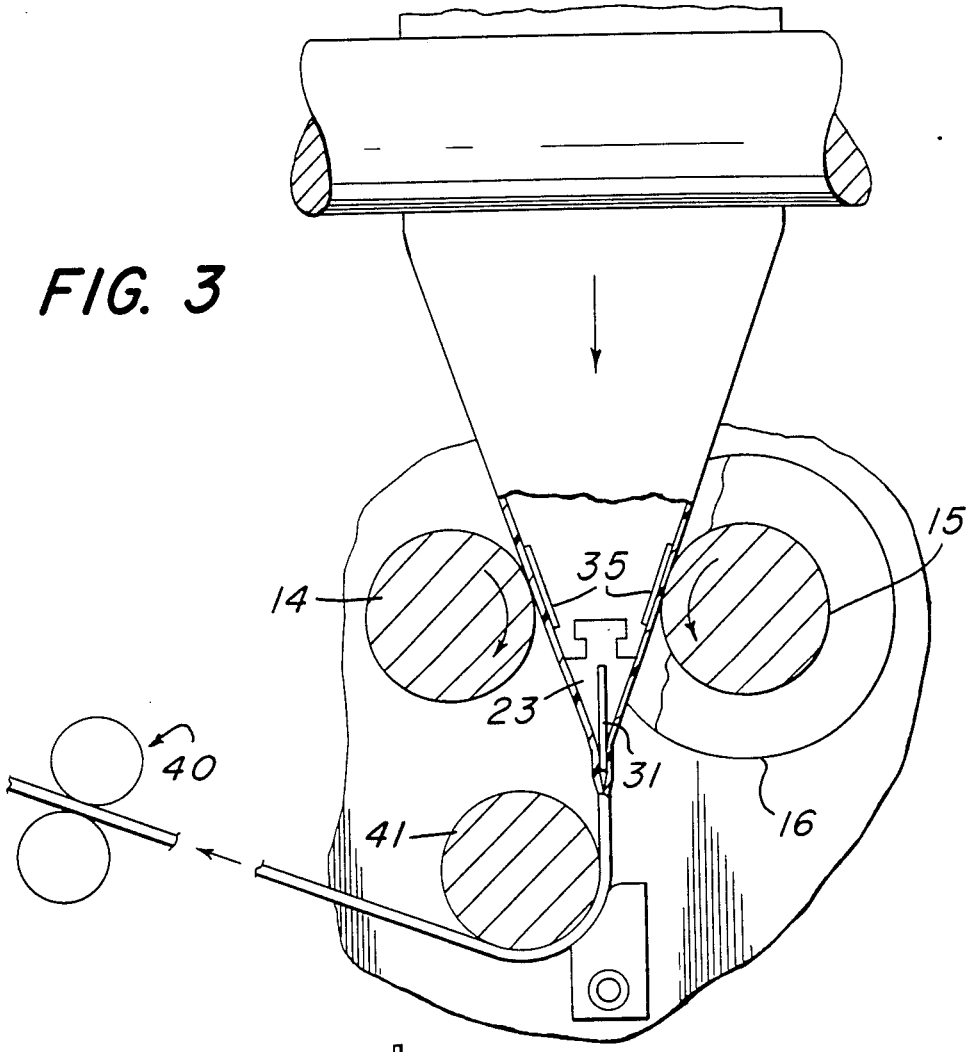
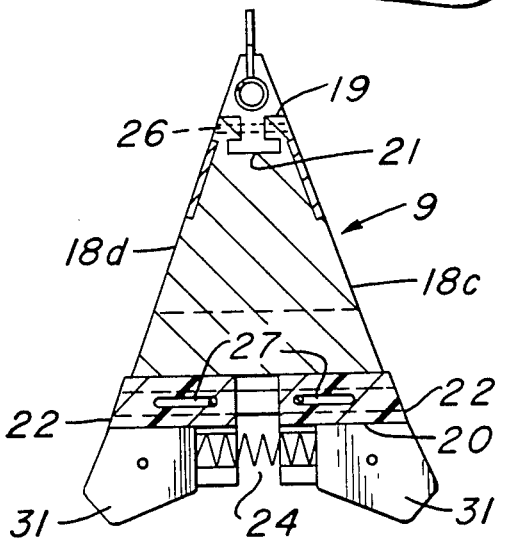
FIG. 5

MANDREL FOR OPENING A TUBE OF FLEXIBLE MATERIAL

FIELD OF THE INVENTION

In its preferred application, this invention relates to the sealing of containers such as glass bottles with a band of heat sealable plastic material fed in the form of a flat web or tube and more particularly to an opening mandrel for opening the tube, wherein the tube is typically flexible, heat-shrinkable, plastic material.

BACKGROUND OF THE INVENTION

Briefly, the banding material used in the heat sealing of closures to containers is supplied in the form of a substantially continuous roll of tubular material with the walls of the tubular material flattened and fed off the roll as a semi-continuous ribbon having opposed creased edges. The ribbon of banding material is fed from the roll to equipment which opens it and thereafter delivers the opened banding material to a station on a production line where pieces are cut to a suitable size and applied over the lids of containers as they move past the station. Once in place, an application of heat to the banding material causes it to shrink tightly over the lid, providing a protective seal which must be broken in order to remove the lid from the container. As is well recognized, these seals provide a measure of protection to the ultimate purchaser who can readily tell from the condition of the heat sealed band whether someone has opened the container between the time it is sealed and the time of purchase.

The use of tetrahedrally-shaped mandrels having faces which are isosceles triangles to open the band of heat sealable material is known in the art. The banding material is drawn over the mandrel with the common corners of two of the isosceles triangular faces being in alignment with and in contact with the inner surfaces of the opposed creases of the material. As the banding material is drawn relatively lengthwise of the mandrel it is wedged open by these faces. The corners formed at the common base of the other two triangular faces impart creases which are offset by 90° with respect to the original creases. Opening mandrels which perform this function are known per se and are disclosed in U.S. Pat. No. 4,148,171. The imparting of these additional creases acts to open the band and to naturally hold it in the open position so that it can be quickly and reliably fitted over the container lid during the application and sealing steps of the banding process.

SUMMARY AND OBJECTS OF THE INVENTION

The invention described and claimed herein provides improvements in the prior art band opening mandrels which accommodate changes in the dimensions in the band of heat sealable material, and an object of the invention is the provision of a mandrel having pairs of self-adjusting, wing-type corner members at the ends of the edges of each of the two sets of wedging surfaces.

A related object of the invention is the provision of a mandrel for opening a band of flat, tubular material such as a tubular band of heat sealing tape material which substantially reduces the incidence of damage to the material.

A still further object of the invention is the provision of a mandrel which more efficiently opens a flattened band of flexible material.

A still further object of the invention is the provision of a mandrel for opening heat sealing tape or like banding material having improved wear and durability characteristics.

The above and other objects of the invention are achieved by a mandrel which is tetrahedrally shaped having its four faces shaped as equal-sized isosceles triangles with the oppositely disposed faces terminating in common base portions and wherein each of said base portions has a pair of relatively yieldable wedging corner elements disposed at each end thereof, with biasing means for urging said wedging elements relatively outwardly to limit positions at the opposite ends at each of said base portions.

BRIEF DESCRIPTION OF THE DRAWINGS

FIG. 3 is a side elevational view, partly in section, of the apparatus shown in FIG. 2;

FIG. 5 is a sectional view taken on line 5—5 of FIG. 4;

DETAILED DESCRIPTION OF THE PREFERRED EMBODIMENT

Figure 1:
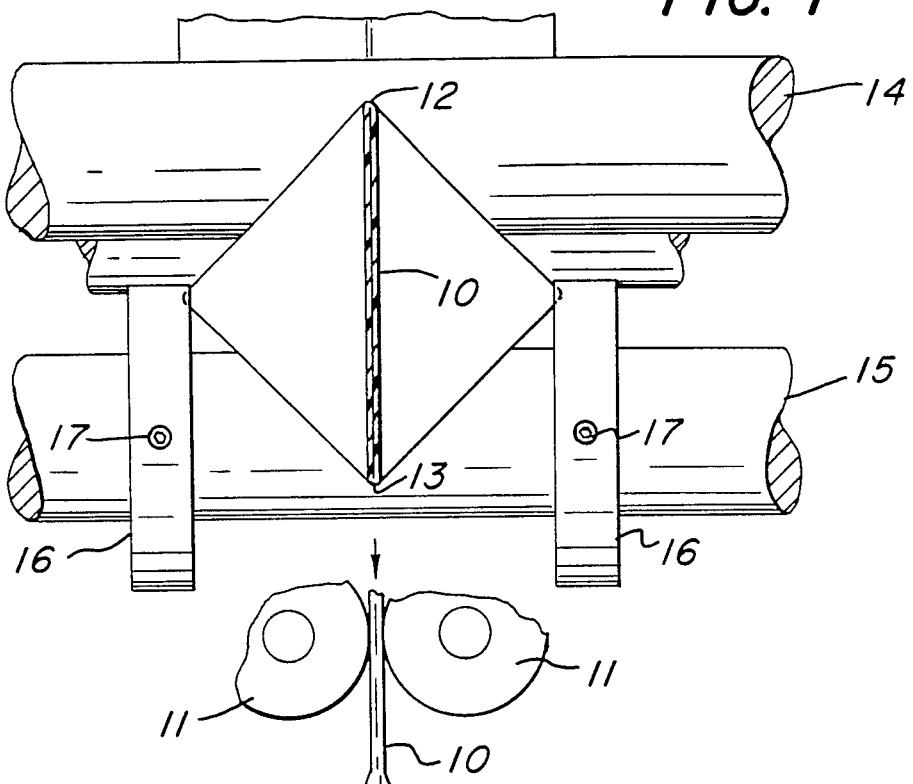
FIGS. 1 and 2 show plan and elevational views respectively of apparatus incorporating the tetrahedrally-shaped wedging mandrels of the present invention.
Figure 2:
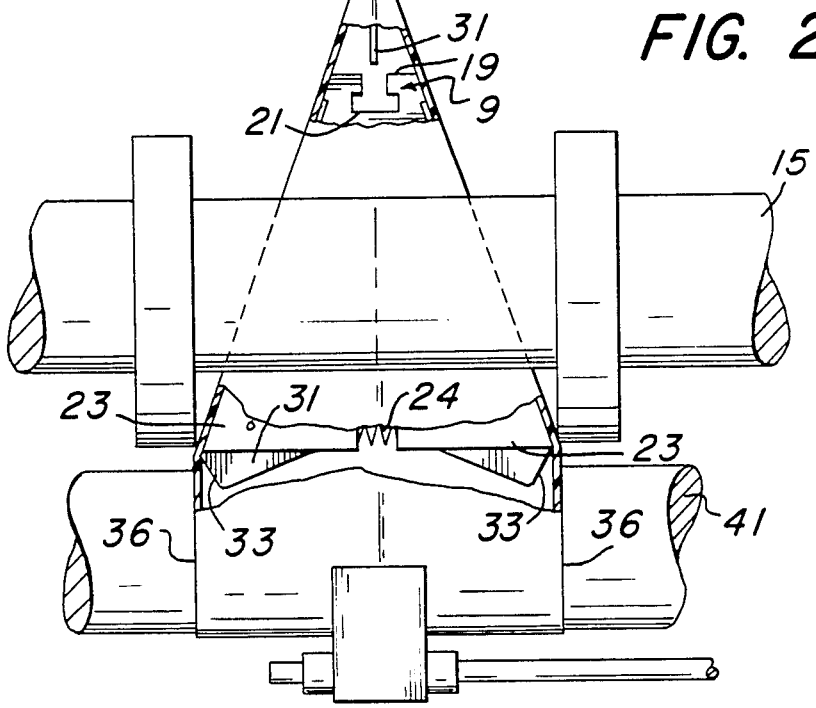

With reference first to FIGS. 1 through 3, and as perhaps is best shown in FIG. 2, the heat sealable tubular banding material in ribbon or tape-like form is shown at 10 as being advanced through a pair of guide rolls 11 from a supply reel not shown. With reference to these drawings it should be understood that the banding material, which is a readily available commercial item, is exaggerated in thickness in the drawings. Banding material of the type used in the invention commonly has a wall thickness of a few thousandths of an inch, although thicker material is sometimes employed as will readily be appreciated by those skilled in the art. As delivered from the reel, the banding material is already provided with sharply creased opposed edges 12 and 13, as can be seen in FIG. 1 where the material is partially shown in section.

In accordance with known procedure, a wedge-shaped mandrel is initially fitted within the tube of material, the tape being broken away in FIGS. 2 and 3 to illustrate the position of the wedge and the way in which the mandrel affects the opening. Briefly stated the mandrel 9 is preferably provided with four isosceles triangular faces so as to form two wedges which are offset from one another by 90°. The tubular mandrel is drawn downwardly relatively to the mandrel and between the surfaces of a pair of spaced apart mandrel support shafts 14 and 15. A pair of retaining collars 16, secured to shaft 15 by means of set screws 17, prevent movement of the mandrel in directions axially of shafts 14 and 15.

Figure 4:
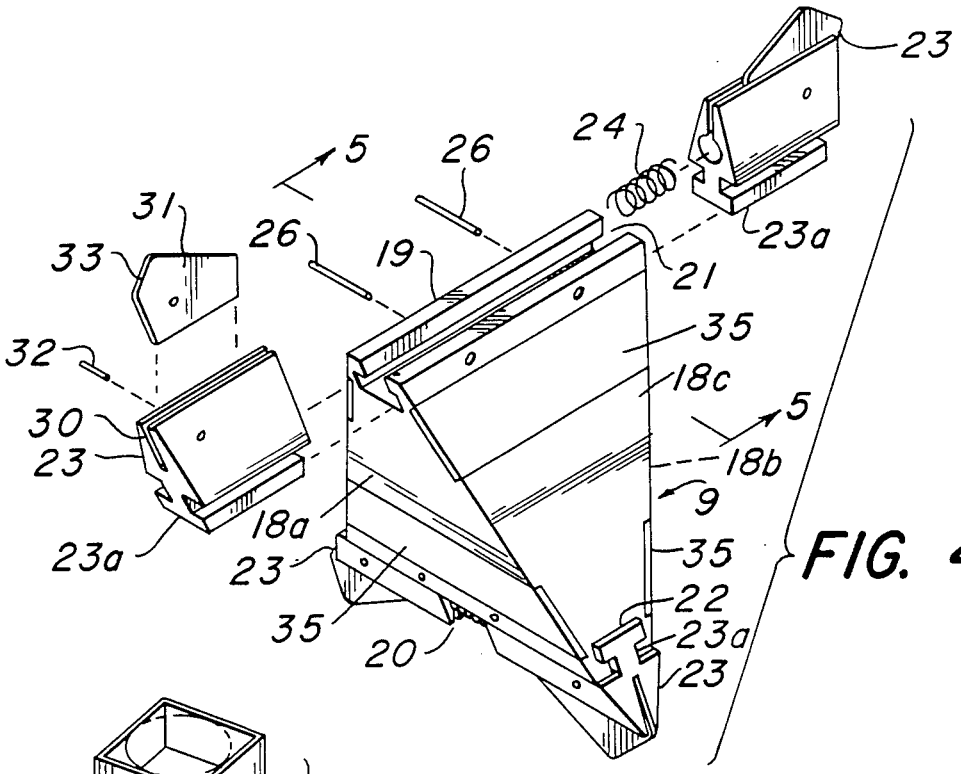
FIG. 4 is an exploded perspective view of a wedging mandrel incorporating the principles of the present invention.
Figure 6:
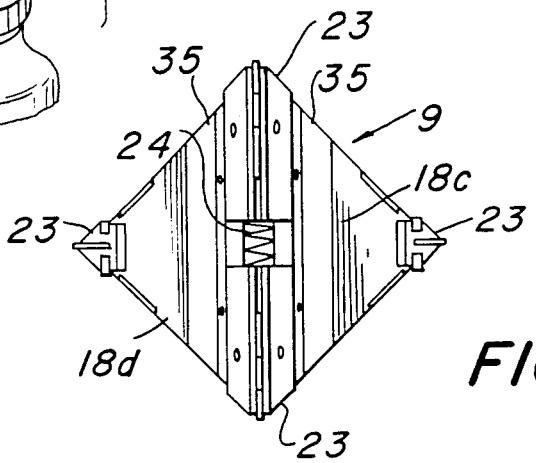
FIG. 6 is a top view of the wedging mandrel of FIG. 5.

With reference now to FIGS. 4 through 6, the generally triangularly-shaped faces are identified by the numerals 18*a, b, c,* and *d,* with each face forming an isosceles triangle. Faces 18*c* and *b* terminate in an elongated common wedging base portion 19, whereas faces 18*a* and *d* terminate in a common base portion 20.

In accordance with the invention, yieldable wedging means are provided at the ends of the common base portions to accommodate differences in the tape size which may arise because of changes in humidity or temperature, or changes occurring because of manufacturing tolerances. Still further the yieldable wedging means allows for occasional misalignment of the tape feed parts relative to the mandrel. For this purpose, base portion 19 is provided with a grooved slot which preferably is in the form of a key way 21. Base portion 20 is provided with a similarly shaped key way or slot 22. Mounted in the slots 21 and 22 for slidable movement therein are parts or wedging extensions 23 having correspondingly shaped key shaped bases 23*a* which fit within the slots. Biasing means comprising a spring 24 urges each set of parts 23 outwardly along the key ways to the outer limits of said base portions. Stop means which conveniently take the form if pins 26 pass through the key ways and through slots 27 within the parts 23 so as to limit movement of the parts. As best shown in FIG. 5 when the parts 23 are in the limit positions to which they are urged by the biasing spring 24, their outer surfaces substantially act as extensions of the adjoining opposed set of triangular faces and their side surfaces incline toward one another as extensions of the other set of triangular faces. Thus the parts 23 form laterally yieldable wedging extensions of the wedging base portions 19 and 20.

Preferably parts 23 are further provided with lengthwise slots 30 which receive thin plates made of metal or like relatively stiff material, the plates 31 being held in place within the slots by such suitable means as pins 32. Preferably, the plates 31 each have an inclined edge portion 33 which inclines inwardly from the ends of the wedging extensions 23.

As set forth above, the mandrel is adapted to rest on the surfaces of spaced apart rollers or shafts 14 and 15. Preferably hardened steel wear plates 35 extend lengthwise on each face adjacent the base portions 19 and 20. As may be appreciated, the mandrel may be used alternatively with the common base portion 19 facing upwardly or the common base portion 20 facing upwardly. The two pairs of wear surfaces permit position of the mandrel in either of the two positions, with one of the two pairs of wear surfaces resting on the surfaces of shafts 14 and 15.

Figure 7:
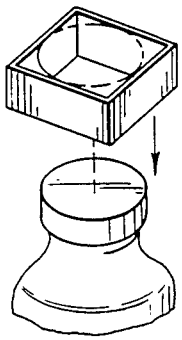
FIG. 7 is a diagrammatic view showing the application of cut pieces of banding material being applied over the closure cap for a container.

In use, the mandrel is initially placed within the band of material with mandrel support being provided by adjacent surfaces of shafts 14 and 15 and with the wall of the tubular material passing between the mandrel and the surfaces of the shafts. Feed or indexing means schematically represented by a pair of rollers 40 in FIG. 3 advances the band material relatively to the mandrel, the mandrel being positioned so that the upper corners of parts 23 are in contact with the inner surfaces of the creases 12 and 13. As the band material is advanced, it is gradually separated by the opposed triangular faces. Variations in dimensions of the band cause a flexing of the biasing spring 24 and an automatic and continuous yielding of the parts 23. As the band moves past the lower movable parts 23, creases 36 are imparted to the tape at positions which are offset 90° from the initial creases. The tape is preferably thereafter drawn around the periphery of a roll 41 which reinforces the formation of the creases 35 and 36. As is recognized, the formation of these creases imparts stresses in the material which gives it a tendency to naturally open which makes it possible to readily and rapidly fit cut-off pieces of the band of heat sealing material over the tops of the containers as best seen in FIG. 7.

The invention eliminates the tearing of the heat sealing material as it is advanced to the application station, allows for significant size variations in the material and substantially eliminates work stoppages which have heretofore arisen for this reason.

What is claimed is:

1. A wedging mandrel for opening a tube of flexible, heat-shrinkable banding material or like tubular material wherein the tubular material is delivered in flat ribbon-like form with creased side edges, said tube opening wedging mandrel comprising first and second sets of planar wedge surface regions, the first and second sets of planar wedge surface regions converging towards and respectively terminating in first and second relatively narrow, elongated, wedge surface portions, the first and second wedge surface portions being disposed at 90° to each other, means for supporting said mandrel with the first of said wedge surface portions being positioned and dimensioned to receive and fit within the tube with the ends of said first wedge surface portion adjacent the creased edges of the tube, feed means for advancing the tube relatively lengthwise of the mandrel whereby the tube is wedged to the opened position, each of said first and second elongated wedge surface portions having a grooved key way extending lengthwise thereof, a pair of relatively moveable wedge-shaped parts mounted on each said first and second elongated surface portion and slidably moveable within the key way on said surface portion, biasing means for yieldably urging each said pair of parts to opposite ends of said elongated wedge surface portion on which said pair of parts is mounted, said parts each having a flat end surface and flat converging wide wall surfaces, the flat converging side and end wall surface of each of said parts being substantially coplanar with the planar surface regions which terminate in and define the elongated surface portion on which the pair of parts is mounted, whereby the pair of parts on the first wedge surface portion resiliently bear against the creased edges of the tube and the pair of parts on the second wedge surface portion bear against the tube at positions disposed at 90° to the creased edges of the tube.

2. A wedging mandrel according to claim 1, further including a thin plate member extending lengthwise from the vertex of each of said wedge-shaped parts, each said plate member having an end surface sloping relatively inwardly from the base outer end of the part.

3. Apparatus according to claim 2 further including parallel relatively hard wear surfaces in the wedge surfaces of each set, and spaced apart supports interengageable with one of said set of wear surfaces.

* * * * *